US007012572B1

(12) United States Patent
Schaffner et al.

(10) Patent No.: US 7,012,572 B1
(45) Date of Patent: Mar. 14, 2006

(54) INTEGRATED ULTRA WIDEBAND ELEMENT CARD FOR ARRAY ANTENNAS

(75) Inventors: James H. Schaffner, Chatsworth, CA (US); William B. Bridges, Sierra Madre, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/892,947

(22) Filed: Jul. 16, 2004

(51) Int. Cl.
*H01Q 21/00* (2006.01)

(52) U.S. Cl. ..... 343/725; 343/785

(58) Field of Classification Search ..... 343/725, 343/772, 785, 900
See application file for complete search history.

(56) References Cited

U.S. PATENT DOCUMENTS

| | | | | |
|---|---|---|---|---|
| 4,274,097 | A | 6/1981 | Krall et al. | 343/719 |
| 6,266,025 | B1 | 7/2001 | Popa et al. | 343/785 |
| 6,501,433 | B1 * | 12/2002 | Popa et al. | 343/785 |
| 6,693,600 | B1 * | 2/2004 | Elliot | 343/773 |
| 2005/0062483 | A1 * | 3/2005 | Maier | 324/644 |

OTHER PUBLICATIONS

Chen, Chi-Chih, "Novel Wide Bandwidth Dielectric Rod Antenna For Detecting Antipersonnel Mines," *IEEE Geoscience and Remote Sensing Symposium 2000 Proceedings,* IGARSS 2000, vol. 5, pp. 2356-2358 (2000).

Kraus, J.D., *Antennas,* Second Edition, McGraw-Hill, pp. 685-687 (1988).

Lee, J.J., et al., "Wide Band Bunny-Ear Radiating Element," *Antennas and Propagation Society International Symposium,* AP-S Digest, pp. 1604-1607 (1993).

Mahon, S.J., et al., "Wide-Band MMIC Kowari Mixer/Phase Shifters," *IEEE Transactions on Microwave Theory and Techniques,* vol. 49, No. 7, pp. 1229-1234 (Jul. 2001).

Schwering, F., et al., "Millimeter-Wave Antennas," *Antenna Handbook,* vol. III, Y.T. Lo and S.W. Lee, eds., Chapman & Hall, New York, p. 17-44 (1993).

Schwering, F.K., et al., "Other Microwave Antennas," *Handbook of Microwave and Optical Components,* vol. 1, Microwave Passive and Antenna Components, K. Chang, eds., John Wiley & Sons, New York, pp. 647-655 (1989).

* cited by examiner

*Primary Examiner*—Hoang V. Nguyen

(74) *Attorney, Agent, or Firm*—Ladas & Parry LLP

(57) ABSTRACT

An element card for an ultra-wideband array antenna is disclosed. The element card has one or more integrated antennas and can be designed to operate over multiple decades of bandwidth. The element card may be arranged as part of an array of element cards to achieve operation in multiple frequency bands.

37 Claims, 10 Drawing Sheets

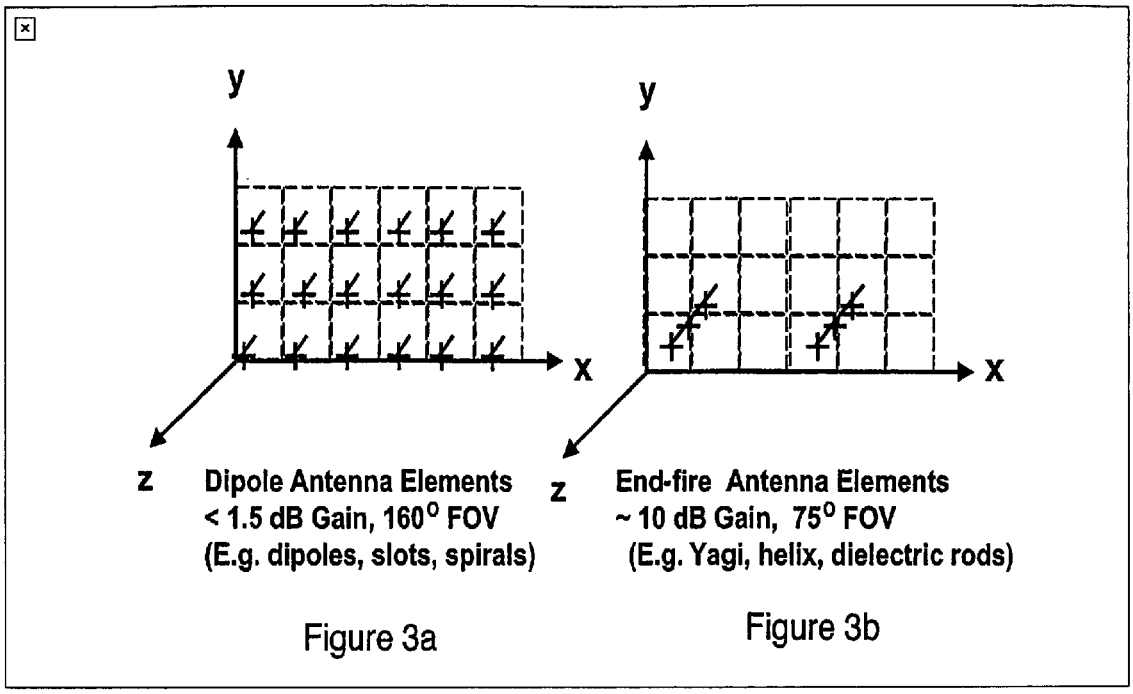
Figure 3a
Figure 3b
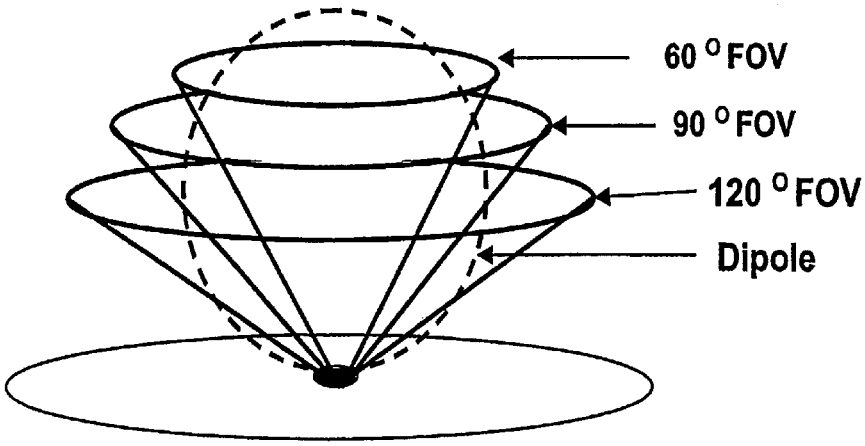
Figure 4

INTEGRATED ULTRA WIDEBAND ELEMENT CARD FOR ARRAY ANTENNAS

TECHNICAL FIELD

The present disclosure relates to ultra-wideband array antennas. More particularly, this disclosure relates to an element card or an array of element cards for use in connection with ultra wideband antennas, particularly antennas that can be designed to operate over multiple decades of bandwidth.

BACKGROUND INFORMATION

1. Introduction

It is difficult to attain bandwidth greater than 10% of the operating frequency from a single radiating element. Tapered slot antennas have been reported (see the Lee and Livingston article cited below) to achieve broadband operation; however, for use in an array, the size of the radiating elements in the array would be greater than ½ λ at the highest frequency of operation, resulting in grating lobes, else the size of the radiating element is too small at the lowest frequency, resulting in a very difficult impedance match. The problems of impedance matching and array spacing are further exacerbated when these elements are arrayed for dual polarization.

The present disclosure relates to an element card for an ultra wideband array antenna. Ultra wideband operation is achieved by using multiple radiating elements, each optimized for a particular frequency band. These radiators are then integrated onto a single element card. In addition, high gain radiators are preferably used, which have thin cross-sections, so that the elements can be placed close together with minimal mutual coupling. Since the element cards are fabricated with individual radiators, cards only need to include those radiators necessary to maintain grating free spacing operation, thus resulting in a thinned array and reduced cost and weight.

J. J. Lee and S. Livingston in "Wideband bunny-ear radiating element," *Antennas and Propagation Society International Symposium,* 1993 AP-S Digest, 1993, pp. 1604–1607, describe a wideband flared notch printed circuit radiation element for operation from 0.5–18 GHz. While the element achieves 36:1 bandwidth, its use in an array is severely limited in bandwidth to less than 2:1 because the element size is greater than ½ λ at the highest frequency.

The element card disclosed herein uses high gain dielectric rod antennas at the higher frequencies, and preferably a small TEM horn at the lower frequencies. Radiating elements of the present invention can be placed much closer together than for the flared notch, and each radiator can be impedance matched separately rather than trying to do an ultra wideband impedance match. The multiplexing of signals of the element card disclosed herein can be done in the beamformer using standard multiplexing microwave circuits. The dielectric rod antennas may be cladded so that they are operable in multiple frequency bands.

Adrian E. Popa and William B. Bridges in U.S. Pat. No. 6,266,025 dated Jul. 24, 2001 and entitled "Coaxial Dielectric Rod Antennas with Multi-Frequency Collinear Apertures" describe the use of dielectric rod antennas with core and cladding cross-sections to achieve wide bandwidth from a radiating element. The feed structure disclosed in that patent includes collinear round waveguides, which are 1) limited in bandwidth, and 2) not easily integrated with low-cost printed circuit feed circuits.

The present disclosure improves on this prior art by teaching how to make low-cost printed circuit cards that can be integrated with one or more uncladded or cladded dielectric rod antennas. Furthermore, the present disclosure demonstrates how other types of transmitting and/or receiving structures, such as TEM horn antennas, can be integrated therewith to form an ultra wideband element card radiator and/or receiver. In addition, the present invention shows how to use these cards in beam steering arrays.

Albert D. Krall and Albert M. Syeles in U.S. Pat. No. 4,274,097 dated Jun. 16, 1981 and entitled "Embedded Dielectric Rod Antenna" present a dielectric rod antenna that is surrounded by a lower dielectric constant material. It is used to make the dielectric rod antenna compact. It is not the same arrangement as U.S. Pat. No. 6,266,025, above. For example, the surrounding cladding material is not tapered. It suffers from difficulty in feeding and is not compatible with printed circuit technology.

None of these prior art references address how to utilize their antenna elements in an ultra wideband, low cost array.

2. Dielectric Rod Antennas

Dielectric rod transmission lines and antennas have been studied for more than 60 years. Some advantages of using a dielectric rod antenna over metallic elements or other dielectric based antennas, particularly for microwave and millimeter wave frequencies include:

1) Large effective aperture—In volumetric, traveling wave type antennas such as the long Yagi, the helix and the dielectric rod, antenna gain is a function of the length of the antenna in the direction of wave propagation along the antenna rather than the transverse dimensions of the antenna. This means the effective area $A_{rM}$ is much larger than its physical transverse cross section.
2) Low-cost manufacturing—Dielectric rod antennas can be fabricated through molding techniques, and integrated onto printed circuit boards. A transition from microstrip into the dielectric rod antenna facilitates matching the dielectric rod antenna to active components such as amplifiers, lasers, or mixers.
3) Ease of integration with other antenna components—Since the dielectric rod antenna can be integrated onto a printed circuit board, it can also be mechanically integrated with other printed circuit antennas. The small physical aperture for a dielectric rod antenna with high gain (7–20 dB) helps to mitigate mutual coupling effects with these other antennas.

Additionally, at millimeter wave frequencies, the dielectric rod antennas will have lower loss compared to metal based printed circuit antennas such as notches and dipoles (i.e. Yagi or vee type antennas).

The basic dielectric rod antenna, shown in FIG. 1, provides a unique transmission line antenna that has a number of features and benefits that can be exploited for optimizing large diameter (narrow beamwidth), wide bandwidth (multi-octave), wide field-of-view (FOV), phased array antennas. The directivity of the dielectric rod antenna is a function of the length of the dielectric rod. For maximum directivity, the base diameter D should be:

$$D = \frac{\lambda_0}{\sqrt{\pi(\varepsilon_r - 1)}}$$

Past designs for dielectric rod antennas have focused on maximum on axis gain in a narrow frequency band, and in fact, "information on the bandwidth of tapered-rod antennas is scarce" as disclosed in F. Schwering and A. A. Oliner in "Millimeter-Wave Antennas" *Antenna Handbook, Volume III*, Y. T. Lo and S. W. Lee, eds., Chapman and Hall, New York, 1993, pp. 17–44. Since there is neither low frequency cutoff for the $HE_{11}$ mode on the dielectric waveguide, nor any high frequency limit, the bandwidth of an antenna using dielectric waveguide is, in principle, unlimited. In practice, however, the bandwidth is limited for a given desired gain on the low end by excessive wave leakage. On the high frequency end, it is usually limited by the appearance of higher order modes of transmission in addition to the fundamental $HE_{11}$ mode. Of course, the bandwidth of the dielectric rod antenna can also be limited by the feed structure unless it is specifically designed to have broad bandwidth as well. For example, the "Polyrod" antennas of World War II were fed by resonant microwave cavities, and exhibited quite narrow bandwidths. For waveguide fed antennas, the usable bandwidth approaches approximately 2:1, and a 3:1 bandwidth antenna has been recently reported in Chi-Chih Chen in "Novel Wide Bandwidth Dielectric Rod Antenna for Detecting Antipersonnel Mines," *IEEE Geoscience and Remote Sensing Symposium* 2000 *Proceedings*, IGARSS 2000, Vol. 5, pp. 2356–2358. Dielectric rod surface wave antennas can be designed for omnidirectional applications or for end-fire applications with gains up to 20 db. See J. D. Krause, *Antennas*, McGrall-Hill, $2^{nd}$ Ed. 1988.

To extend the bandwidth of a dielectric rod antenna, a new collinear, coaxial dielectric rod antenna was invented. See U.S. Pat. No. 6,266,025. The coaxial dielectric rod antenna, shown in FIG. 2, includes a lower frequency range dielectric rod antenna with a tapered radiating aperture with an embedded higher frequency band coaxial dielectric transmission line terminating in a second dielectric rod antenna radiating aperture. Each radiating rod can be designed for optimized gain patterns and the high band antenna is designed with a low frequency cutoff near the highest operating frequency selected for the low frequency band antenna.

The structure, shown schematically in FIG. 2, consists of a dielectric rod 201 inside a tapered dielectric cylinder 202 of somewhat lower dielectric constant. The tapered end 203 of the central rod 201 is the radiating structure for higher frequencies (i.e. for a higher frequency band) while the tapered cylinder 204 plus the central rod 201 together is the radiating structure for lower frequencies (i.e. for a lower frequency band). The antenna structure can have additional dielectric structures to thereby increase the number of different radio frequency bands served by the dielectric rod antenna 501. Generally speaking, the TEM horn antenna 502 serves a lower frequency band than the band(s) served by the dielectric antenna 501.

The outer cylinder 202 serves as a cladding around the inner core 201, which forms a non-radiating transmission line for an upper octave. Even though the embedded inner core 201 has no low frequency cut-off, the cladding layers help to contain the electric field density at low frequencies for guidance to the radiating taper 202. At higher frequencies, the electric field is constrained to be more in the higher dielectric constant core 203. The antenna feed may operate as a single mode waveguide up to the next higher order mode cut-off frequency, which should lie between the next higher mode cut-off frequency of a homogenous cylindrical waveguide of the cladding layer diameter and the next higher mode cut-off frequency of a homogenous cylindrical waveguide of the core region. The result is an embedded dielectric rod antenna with a diameter of the outermost cladding layer that has an extended operational frequency than could be obtained with a homogeneous material dielectric rod antenna. Separate metallic feed structures 206, 207 (shown conceptually in FIG. 2 as metal waveguides, which limit the bandwidth to a single octave for each feed) feed each radiator.

3. TEM Horn Antennas

At RF and low microwave frequencies, the width of dielectric rod antennas becomes large and another type of antenna must be integrated into the broadband card to keep the size and weight of the card as little as possible. One antenna that can give relatively large bandwidths is the transverse electromagnetic (TEM) horn antenna. Basically, a TEM horn 502 is just a horn antenna, but with the sides removed. Generally these antennas are fed by parallel plate waveguide and do not need to be integrated onto printed circuit boards 500 with the other dielectric antenna elements 501.

4. Array Thinning

This information is included for a better technical understanding of some of the array aspects of the present invention to be discussed later. A receiving antenna will pick up energy from an incident plane wave and will feed it into a transmission line that terminates in an absorbing load, such as a detector, mixer or low noise amplifier. The amount of energy absorbed in the load will depend on three factors, the orientation of the antenna, the polarization of the wave, and the impedance match in the receiving system. If these factors are set for maximum power absorbed, the absorbed power can be expressed as an effective receiving cross-sectional area $A_{rM}$ of the antenna.

The maximum gain $G_M$ of an antenna is the greatest factor by which the power transmitted in a given direction can be increased over that of an isotropic radiator. As a consequence of the reciprocity theorem it can be shown that the ratio $A_{rM}/G_M$ is constant for all matched antennas:

$$A_{rM}/G_M=\lambda^2/4\pi$$

Where:

$A_{rM}$ is the maximum effective receiving area $G_M$ is the maximum gain $\lambda$ is the wavelength The implication of this result is that $A_{rM}$ is a function of the gain and the wavelength, and while $A_{rM}$ can be approximated by the physical aperture for many planar antennas, this is not true for many three dimensional volumetric antennas in common use. In volumetric, traveling wave type antennas, such as the long Yagi, helix and dielectric rod, the gain is achieved in the direction of wave propagation on the antenna which can significantly increase the effective receiving cross-sectional area $A_{rM}$ beyond the physical aperture of the elemental antenna in the plane of an array as demonstrated in FIGS. 3*a* and 3*b*. This increase in effective aperture and the subsequent ability to reduce of the number of elements in the physical aperture is known as array thinning If the pattern of the elemental antenna can be designed to fill the field-of-view (FOV) of the electronically steered array, elemental antenna gain can be used to increase the effective aperture and to reduce (thin) the number of elements in the physical aperture. This thinning is illustrated in FIG. 4 and tabulated in Table I for several FOVs.

TABLE I

| Field of View (FOV) | Directivity | Element Gain Over Dipole | Array Element Thinning Over Dipoles λ/2 Spacing |
|---|---|---|---|
| 60° | 8.9 | 9.5 dB | 89% |
| 70° | 6.9 | 8.4 dB | 85% |
| 80° | 5.4 | 7.3 dB | 81% |
| 90° | 4.3 | 6.3 dB | 76% |
| 100° | 3.5 | 5.5 dB | 72% |
| 110° | 3.0 | 4.7 dB | 66% |
| 120° | 2.5 | 4.0 dB | 60% |
| Biconical Dipole | 1.5 | 0.0 dB | 0% |

EMBODIMENTS AND DIFFERENT ASPECTS OF THE PRESENT DISCLOSURE

An element card for an ultra-wideband array antenna is disclosed herein. This card has integrated antennas and, as a whole, can be designed to operate over multiple decades of bandwidth. Embodiments of the element card for an ultra-wideband antenna are described as follows:

1) An element card comprised of integrated radiators, each individually designed for separate operational frequency bands, and taken as a whole can achieve ultra-wideband performance. The support substrate onto which the antennas are integrated is preferably fabricated from standard printed circuit board materials and multi-layer processing to facilitate integration of the finished array (of many element cards) to passive, active, or photonic beamforming networks.
2) An image guide transmission line comprised of an embedded core and one or more surrounding claddings collinear along the direction of RF wave propagation with the end tapered into a core and clad dielectric rod antenna. Control of the dimensions and electrical properties of core and cladding regions are used to obtain the required frequency bands of operation (which need not be contiguous).
3) Wideband transitions from one or more microstrip transmission lines to bring the RF energy into the collinear embedded image guide.
4) An integrated, electrically small, TEM horn integrated onto the same ultra wideband card as the embedded dielectric rod antennas.
5) An antenna array comprised of ultra wideband element cards to provide dual polarization radiation.
6) An antenna array to provide circular switched beam coverage over ultra wide bandwidths.

This novel ultra wideband beam steering array device has many commercial applications (for example, mobile communications, space-based radar, and airborne and ship-based radar, communications, and direction finding).

SUMMARY

Embodiments of the present invention provide an integrated wideband element card. The element card of the present invention preferably has one or more dielectric rod antennas that may be used for upper frequency band(s) on a first side of the card and a TEM horn antenna on a second side of the card that would be used for lower frequency bands.

In one embodiment the disclosed technology relates to a device comprising an element card having one or more embedded dielectric rod antennas disposed on a first side of the element card and a TEM horn antenna disposed on a second side of the element card, the one or more embedded dielectric rod antennas being tuned for relatively higher frequencies in a frequency band of interest and the TEM horn antenna being tuned for relatively lower frequencies in the frequency band of interest.

DESCRIPTION OF THE DRAWINGS

FIGS. 3*a* and 3*b* are examples of how volumetric, traveling wave type antennas, dipoles and end-fire antennas, respectively, can increase the effective receiving cross-sectional area beyond the physical aperture of the elemental antenna in the plane of an array.

FIG. 4 is an illustration of array thinning for several fields of view.

DETAILED DESCRIPTION

Figure 1:
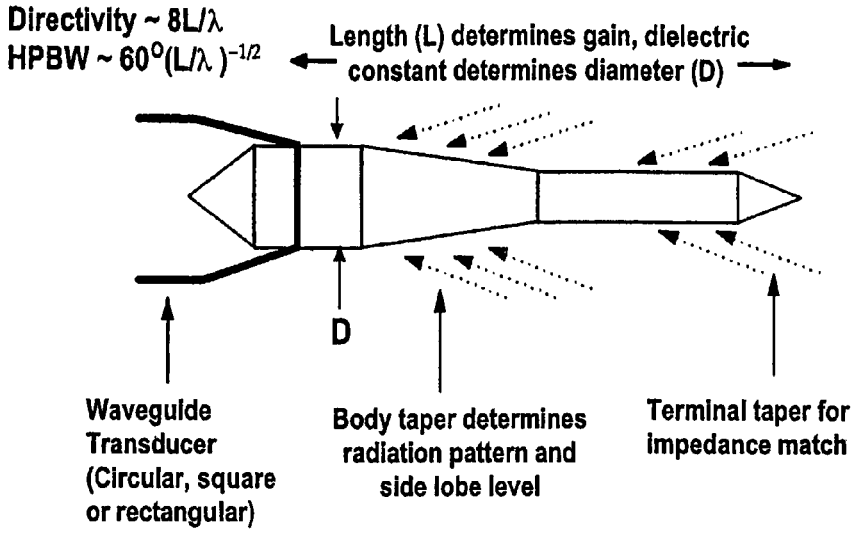
Figure 1 Prior art
FIG. 1 is an example of a prior art dielectric rod surface wave antenna that can be designed for omnidirectional applications or for end-fire gains up to 20 dB per element.
Figure 2:
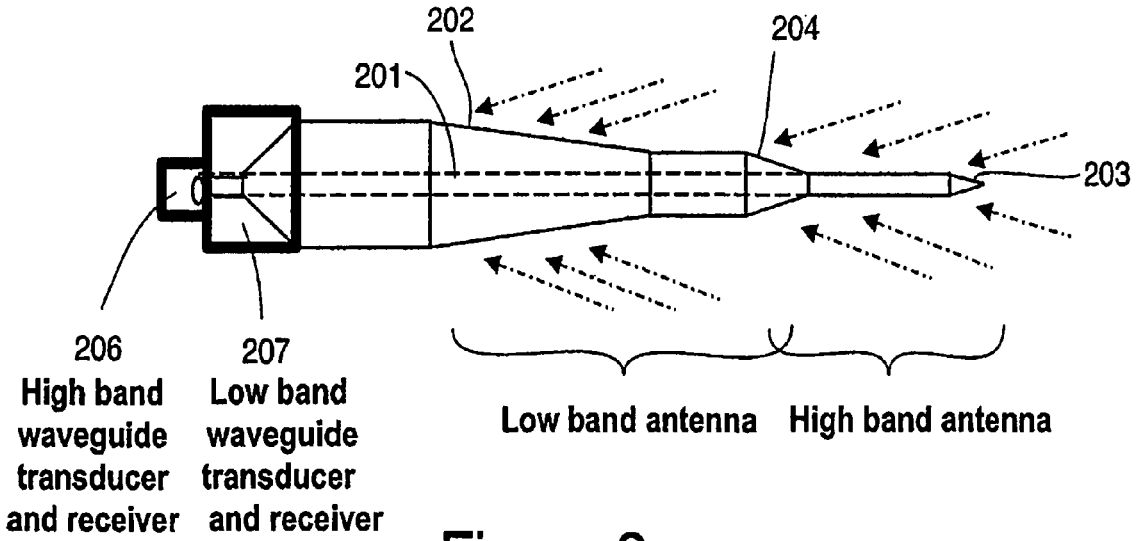
Figure 2 Prior art
FIG. 2 is an example of a prior art collinear, coaxial dielectric rod antenna.
Figure 5:
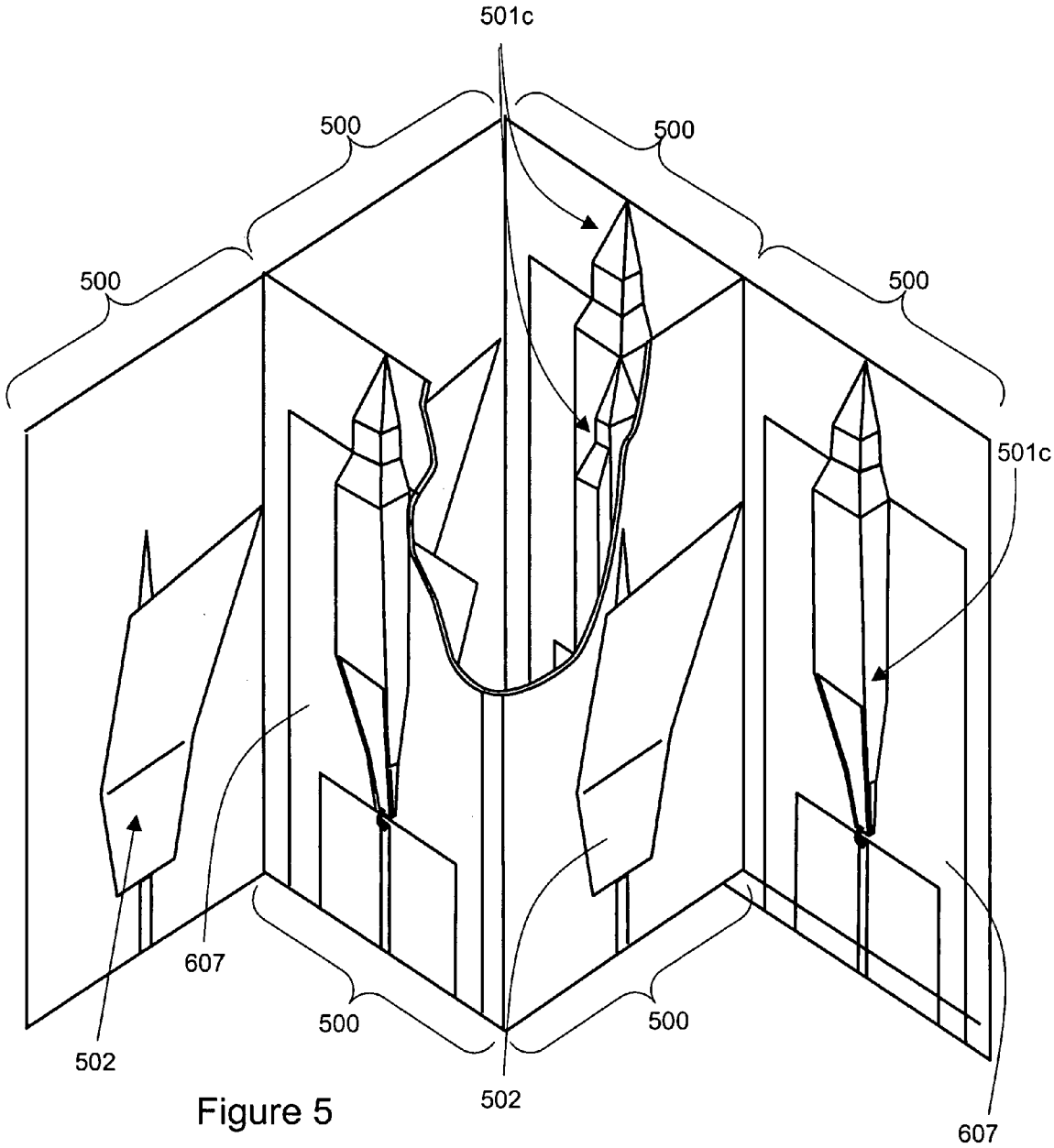
FIG. 5 is a cut-away, perspective view of an embodiment of a section of an ultra wideband array using element cards with embedded dielectric rod antennas for high frequencies and stamped metal TEM horn antennas for low frequencies according to the present invention.
Figure 6:
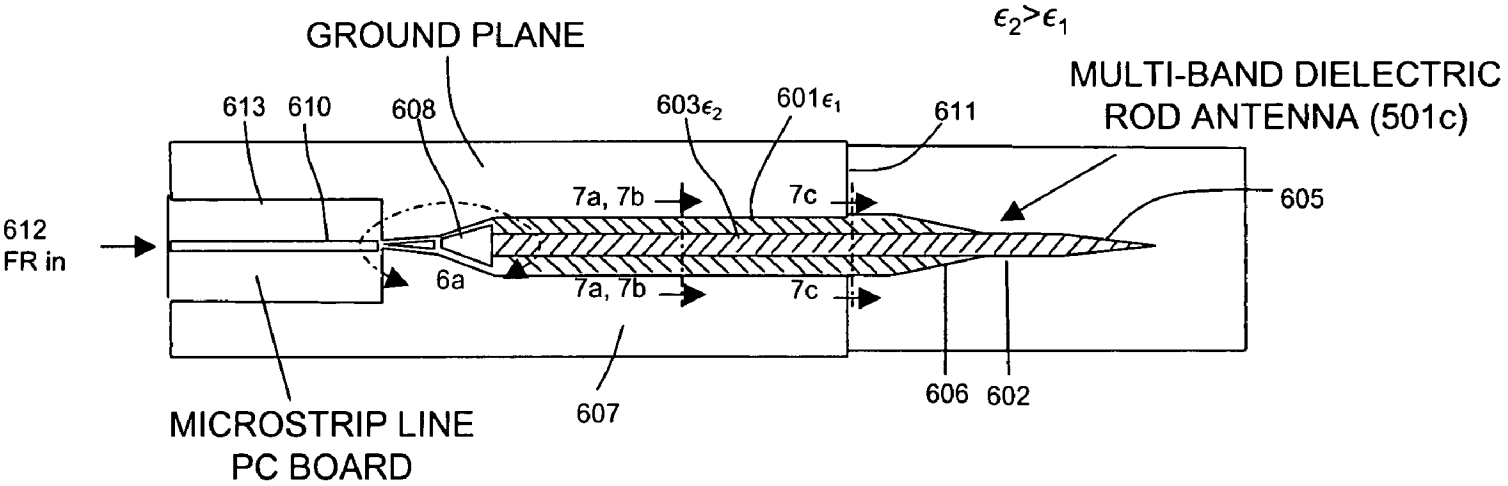
FIGS. 6 and 6*a* depict an embodiment of the high band side of an ultra wideband element card showing an embedded dielectric rod antenna according to the present disclosure, FIG. 6 being a partial sectional view through the dielectric core and dielectric cladding as shown by the section lines in FIGS. 7*a* and 7*b*.

A three dimensional perspective, partially cut-away view of a plurality of element cards 500 with an embedded dielectric rod antenna 501 on a first side of each card and a TEM horn antenna 502 on a second side of each card is shown in FIG. 5. In this view portions of six different cards 500 can be seen, the individual cards 500 being arranged in a geometric pattern (a square pattern in this embodiment). FIG. 6 is a cross sectional view through a single cladded (or embedded) dielectric rod antenna 501*c* in a plane parallel to the substrate of card 500. The substrate of each card 500 may be made using printed circuit board technology, therefore the substrate is a dielectric material. Each card 500 has a ground plane 607 associated therewith, which is easily provided using printed circuit board technology. The dielectric rod antennas 501 are disposed partially on the ground plane 607 and partially off the ground plane 607 on the substrate of each card 500. Indeed, the portions of the dielectric rod antennas that are not disposed on the ground plane 607 may project beyond card 500, if desired. The reference numeral 501 is used to refer to both cladded and uncladded dielectric rod antennas. When the context requires, the letters c or u are appended thereto to refer to cladded dielectric rod antennas (501*c*) and to uncladded dielectric rod antennas (501*u*).

For clarity, one cladded (or embedded) dielectric rod antenna 501*c* is shown for each card 500 in FIG. 5; however, a card 500 may contain multiple embedded dielectric rod antennas 501*c* or a single card may have one or more uncladded (unembedded) dielectric rod antennas 501*u*.

The cladded dielectric rod antennas 501*c* have a central rod 603 which terminates with a radiating, tapered portion 605. The central or core rod 603 normally used in a cladded dielectric rod antenna 501*c*, may be utilized as the uncladded version of the dielectric rod antenna 501*u* by omitting cladding layer 601. The dielectric rod antennas 501, when cladded (e.g. when embedded with core 603), operate at multiple frequency bands. The embedded dielectric 603 acts as a relatively higher frequency antenna while the outer cladding 601 acts as a relatively lower frequency antenna. The tapered portion 606 of the outer cladding acts as the radiating portion of the lower frequency antenna while tapered portion 605 of the inner core 603 acts as the radiating portion of the higher frequency antenna. Note that both radiating portions 605 and 606 extend beyond the limit or edge 611 of ground plane 607. As will be seen, certain cards 500 may have uncladded dielectric rod antennas 501*u* while other cards 500 may have cladded dielectric rod antennas 501*c*, due to array thinning.

At any given cross-section through a cladded rod antenna 501*c*, there is preferably only a single core region 603 and preferably a single cladding region 601, the cladding region having a lower dielectric constant than the dielectric constant of the core region 603 (including its tapered portion 605). Uncladded dielectric rod antennas 501*u* have no cladding region 601. Moreover, cladded (embedded) dielectric rod antennas 501*c* and image line feed structures 603, 604 may include more than one cladding region, thus extending the bandwidth of a single radiating element further than the embodiment shown in FIG. 6.

Each card 500 need not be identical to one another. Indeed, with array thinning (which is discussed below with reference to FIG. 11), some cards 500 may be equipped with one or more uncladded embedded dielectric rod antennas 501*u* (which have a single frequency band of operation) while other cards 500 would be equipped with one or more cladded embedded dielectric rod antennas 501*c* (which have multiple frequency bands of operation) and while still other cards 500 may be equipped with TEM antennas 502. Those cards equipped with a TEM antenna 502 may also have at least one or more uncladded embedded dielectric rod antennas 501 and may alternatively be equipped with one or more cladded embedded dielectric rod antennas 501.

Each side of the element cards 500 will now be described in further detail. The embedded dielectric rod antennas 501*c* is used for the higher frequency band while the TEM horn antenna 502 is used for the lowest frequency band would. If one assumes a conservative limit that the bandwidth of a single embedded dielectric rod antenna 501*c* is 4:1, then 16:1 or more bandwidth can be achieved if two embedded dielectric rod antennas 501*c*, each with different cross-section dimensions, are used on the first side of a single card 500. Thus, for example, while a single embedded dielectric rod antenna could cover the 15–60 GHz frequency band, an element card 500 with a pair of embedded dielectric rod antennas 501*c* could cover a wider 4–60 GHz frequency range instead. The lower frequency of the frequency range would be determined by the cross-section dimensions of the rod, given by equation (1) (for semicircular cross-sections). At low frequencies, dielectric rods become too big for use in the array and the TEM horn 502 (which may be, but need not be, disposed on the other side of the card 500) takes over for the lower frequencies. TEM horns 502 can achieve about 6:1 bandwidth, so that the total bandwidth achievable with such an embodiment of an element card 500 would be more than (i) 24:1 with a single embedded dielectric rod antenna 501*c* together with a TEM horn antenna 502 and (ii) more than 96:1 with a pair of embedded dielectric rod antennas 501*c* together with a TEM horn antenna 502.

Figure 7A:
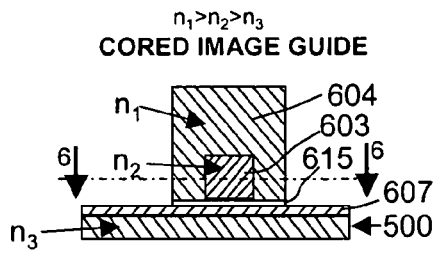
FIGS. 7*a* and 7*b* are cross section views of two embodiments of embedded image guide structures for launching into the embedded dielectric rod antenna according to the present disclosure.
Figure 7B:
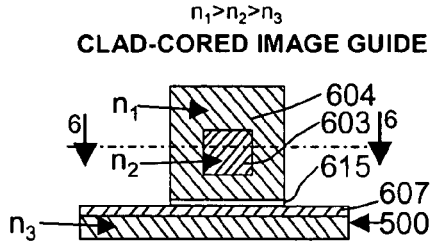
Figure 7C:
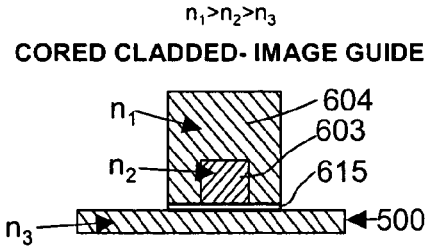
FIG. 7*c* is a cross section view corresponding to the embodiment of FIG. 7*a*, but shown where the dielectric rod antenna is spaced from the ground plane.

The side of the element card 500, which supports the dielectric rod antenna(s) 501, is shown in FIG. 6 where, for clarity, only a single embedded dielectric rod 501*c* is depicted, although multiple embedded dielectric rod antennas 501*c* could be utilized. A single dielectric rod antenna 501*c* preferably consists of two sections. The first section 601 provides an image guide feed to the second section 602, which includes the tapered dielectric rod antenna section 605. The image guide 601 in cross-section contains the core 603 of dielectric material of dielectric constant $\in_1$ and the outer cladding 601 of dielectric material of dielectric constant $\in_2$. These dielectric materials are preferably affixed using a suitable adhesive 615, such as an epoxy cement, adjacent the metal ground plane 607 that is part of the lower portion of the element card 500 (see, for example, FIGS. 7*a* and 7*b*) and adjacent the dielectric material of the upper portion of the element card 500 (see FIG. 7*c*). Three possible rectangular image guide cross-sections are shown in FIGS. 7*a*–7*c*. Cross-sections of other shapes than rectangular could be used. In FIGS. 7*a*–7*c*, $n_i$ is the index of refraction $(\in_i)^{1/2}$ of the $i^{th}$ material and NRD stands for non-radiating dielectric guide. The important relationship between the dielectric constants is that $\in_2 > \in_1$. Any additional cladding layers must be arranged like layers of an onion so that the inner core 603 has the highest dielectric constant, with each subsequent cladding layer having a lower dielectric constant than the previous inner layer. The actual cross-sectional dimensions of the embedded image guide will depend upon the desired frequencies of operation and the dielectric constant of the materials used. Materials with a wide range of dielectric constants are available, for example, Emerson and Cumings Eccostock® material can be commercially obtained with dielectric constants ranging from 3 to 30.

The image guides are tapered to form dielectric rod antennas. The inner, higher dielectric constant core 603 guide extends the furthest before tapering into a dielectric rod antenna 605. The cladding guide 601 is tapered at region 606 to the outer edge(s) of the core guide 603. The tapered region 606 is located beyond the image guide ground plane 607 that ends at its edge or limit 611. The desired operational frequencies, the materials used, and the desired field of view (FOV) determine the actual dimensions of the tapered regions as well as the distance by which core 603 extends beyond the distal end of tapered portion 606 before core 603 starts its taper 605. These dimensions and materials can be determined through electromagnetic simulation or experimentation. The image guide and dielectric rod antennas can be fabricated from casting or machining of the dielectric materials, which may be of the types described above.

Figure 6A:
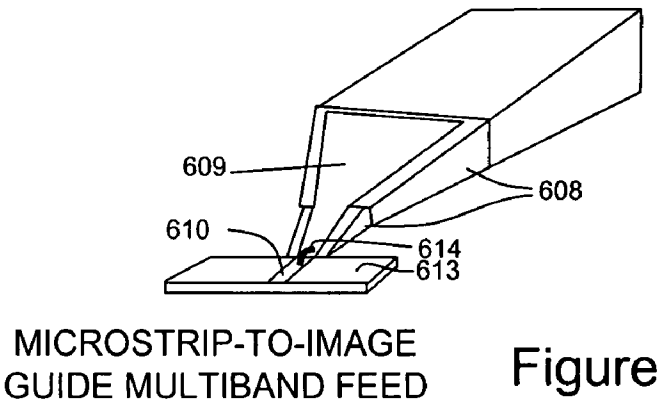

At the RF input 612 to the embedded dielectric rod antenna 501, the dielectric materials are tapered 608 to a ridge as shown in an exploded perspective view (see FIG. 6*a*). A microstrip-to-image guide RF transition 609 connects the embedded dielectric rod antenna 501*c* to a microstrip transmission line feed 610 by, for example, wire bonding (see element 614). The transition acts as a dielectrically loaded horn antenna to launch the RF energy (or receive it) to (or from) the embedded image guide. Launching into a non-embedded image line is known in the art. The exact shape of the transition and the input taper into the embedded image line can be determined by simulation or experiment to maintain a broadband impedance match to the 50 ohm microstrip line, as is known in the art. The input microstrip transmission line 610 can be fabricated, for example, as part of a multi-layer printed circuit board forming the element card 500. The microstrip ground plane is preferably provided by the image guide ground plane 607. The microstrip substrate 613 is preferably designed for a 50 ohm microstrip line (but may be designed instead for any other desired characteristic impedance), which substrate 613 may be formed as part of the element card 500 or may be bonded or attached thereto if fabricated separately.

Figure 8A:
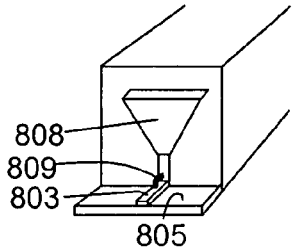
FIGS. 8 and 8*a* depict an embodiment of an alternative feed structure for an embedded dielectric rod antenna according to the present disclosure, FIG. 8 being a section view through the dielectric core and cladding, similar, in this respect, to the view of FIG. 6, but showing the dielectric core exiting the cladding before reaching separate image guide launchers for the dielectric core and for the outer cladding.
Figure 8:
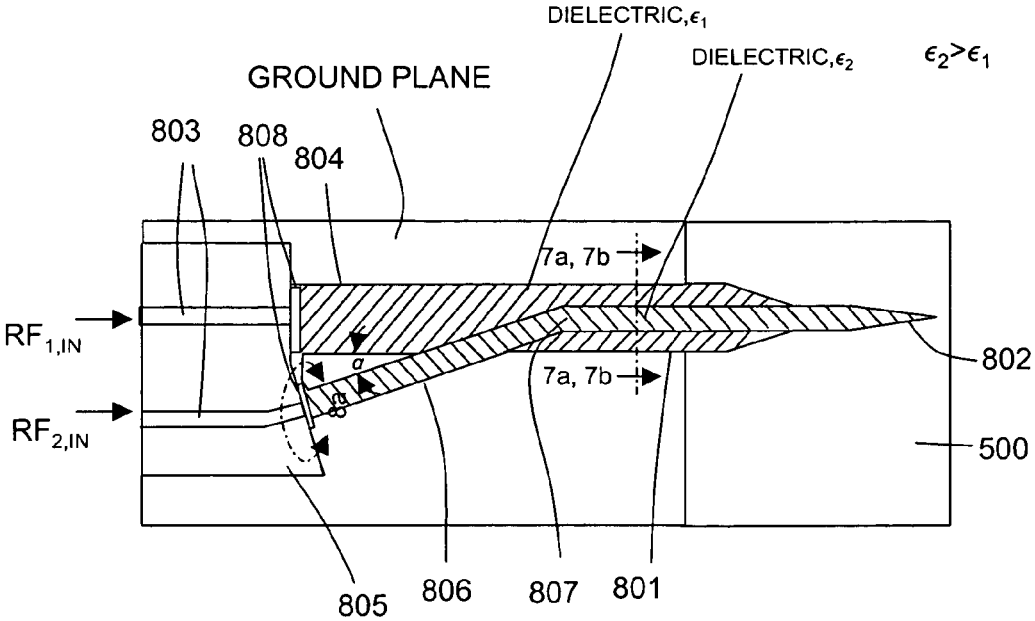

An alternative embodiment of the feed structure for an embedded dielectric rod antenna 501*c* is shown in FIGS. 8 and 8*a*. In the embodiment, the embedded image guide section 801 and the tapered radiation section 802 are the same as that depicted in FIG. 6 for the corresponding structure. Now, however, there are two separate input microstrip transmission lines 803, preferably fabricated on a single printed circuit board 805. Each microstrip line 803 feeds a single, non-embedded image guide 804, 806, where the smaller image guide 806 is fabricated from a higher dielectric constant material. At a location 807 along the length of the card 500, the two guides merge with the smaller guide 806 becoming embedded inside the larger guide 804. The image guide launchers (see FIG. 8*a*) may take the form of a grounded-bow tie antenna 808, which are known in the art and which may be wired-bonded (see element 809) to the microstrip 803. The insertion of the higher dielectric image guide 806 into the lower dielectric image guide 804 so that it becomes the core of the embedded guide 801 occurs at a shallow angle $\alpha$ (preferably less than 20 degrees) to reduce scattering of the RF signal at this juncture. The actual design of this junction and any scattering compensation will depend upon the materials used and the dimensions of the guide and would be typically determined through simulation or experimentation.

Figure 9A:
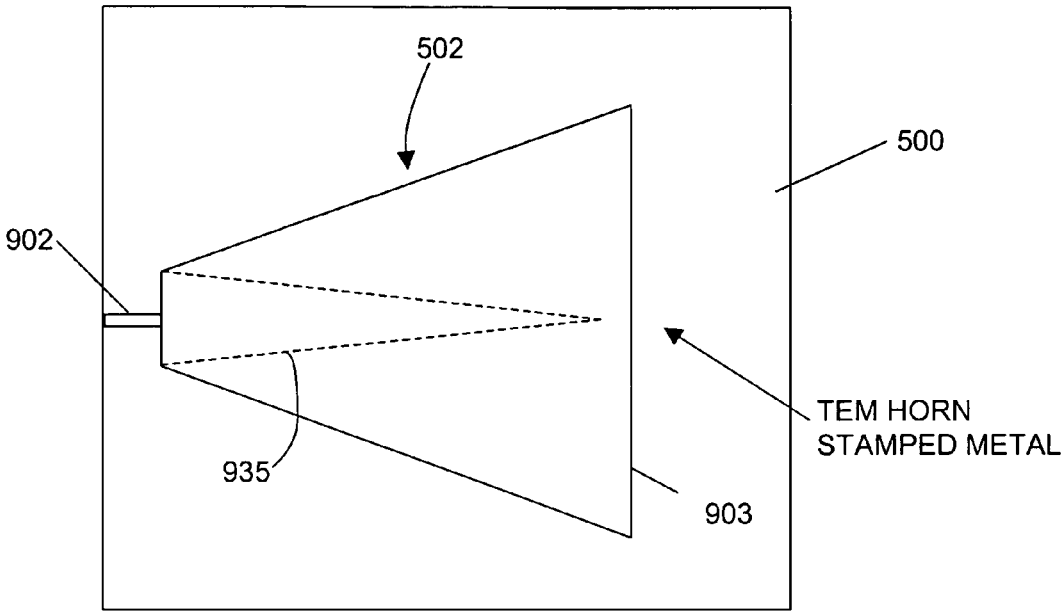
FIGS. 9*a* and 9*b* are top and lengthwise side sectional views of an embodiment of the TEM horn antenna side of an element card according to the present disclosure.
Figure 9B:
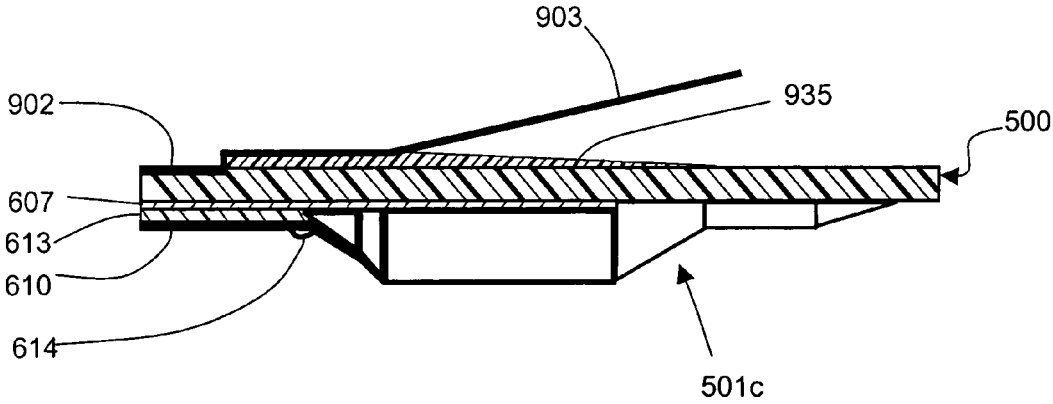

The second side of the ultra wideband card 500 supports the RF and microwave frequency electrically small TEM horn antenna 502. This side of the card is used for the lower frequency bands where metal losses are not as severe as at higher frequencies. The TEM horn side of card 500 is shown in FIGS. 9*a* and 9*b*, which depict a plan view of the TEM horn (FIG. 9*a*) and a lengthwise cross-section view of the element card 500 (FIG. 9*b*) with the cladded dielectric rod antenna 501*c* on one side therefore and the TEM horn 502 on the other side thereof. The TEM horn 502 is preferably fabricated as (i) a triangularly shaped dielectric plate 935 disposed on the dielectric substrate of card 500 and (ii) a trapezoidally shaped metal plate 903 that flares up and away from the dielectric material of plate 935 and substrate 500. Plate 903 is coupled to a microstrip transmission line feed 902. Plate 903 flares so that it becomes wider at the radiating end of the horn 903, while dielectric plate 935 narrows to a point at or near the radiating end of the horn 903. Plate 935 serves as an impedance patching structure. The microstrip 902 is preferably fabricated on the same printed circuit board 500 to which the dielectric rod antenna(s) 501 are cemented on the other side. Except for the transmission line strip 902, all of the printed circuit board metal has been preferably removed from this side of card 500. The TEM horn antenna plate 903 can be manufactured by stamping sheet metal, such as aluminum or copper, and the resulting stampings may then be attached to the printed circuit boards 500 at a junction with the microstrip line 902 using a small rivet (not shown), by re-flow soldering or other techniques known in the art.

An adhesive 615 (see FIGS. 7*a* and 7*b*) is preferably used to adhere the dielectric rod antenna 501*c* (or just the core 603 if the dielectric rod antenna 501*u* is not cladded) to the substrate of card 500. It should be appreciated that the ground plane 607 may be very thin so that the adhesive 615, which is not shown in FIG. 9*b*, can easily adhere antenna 501 to both the substrate and the ground plane 607. Alternatively, the card 500 substrate can be a multilayered printed circuit board structure and, in such an embodiment, the microstrip dielectric 613 may cover all or substantially all of the ground plane 607, in which case the cladded antenna 501*c* (or just its core 605 if the dielectric rod antenna 501*u* is not cladded) may be adhered to dielectric 613 instead.

In general, dielectric rod antennas have large directivities; even a taper of one wavelength has a directivity of approximately 9 dB according to the formula for the base diameter (D) of a dielectric rod antenna. From the information presented in FIG. 4, this element would have a field of view (FOV) of 60°. If a FOV of 120° were desired, it would be necessary to have even shorter tapered sections 605, 606 for the dielectric rod antenna 501*c*. This may lead to difficulty in the impedance matching of the dielectric rod antenna 501*c*. An alternative to having a short tapered section is to break up the FOV into two or three regions and use multiple embedded dielectric rod antennas to cover the region of interest.

Figure 10:
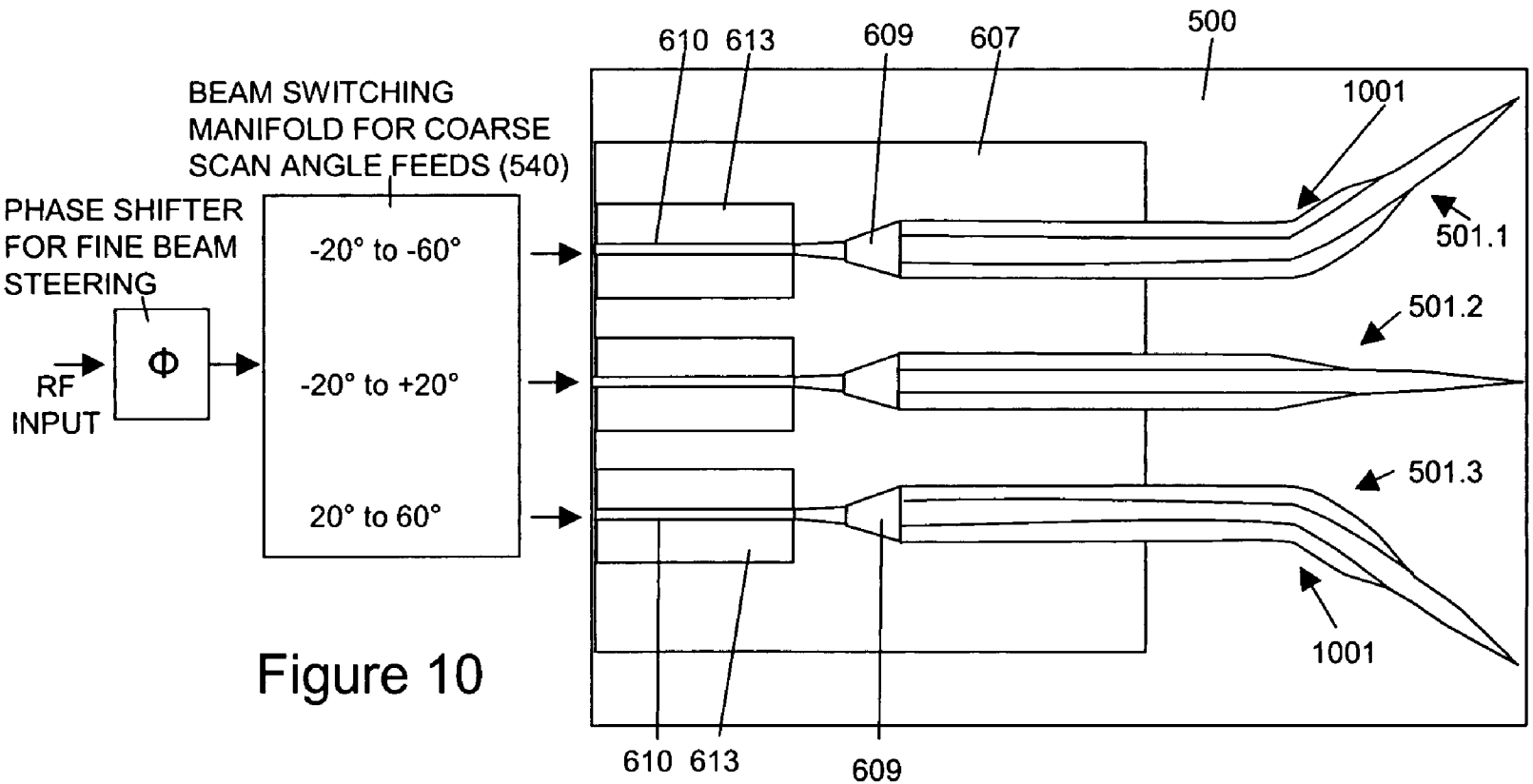
FIG. 10 is an embodiment showing the use of multiple dielectric rod antennas with non-parallel high frequency structure to achieve course beam steering according to the present disclosure.

An embodiment with three cladded dielectric rod antennas 501.1–501.3 on a single card 500 is depicted by FIG. 10 where the two outermost cladded dielectric antennas 501.1 and 501.3 are each configured to have an outwardly "bent" configuration. The bends 1001 depicted by FIG. 10 (and in FIG. 11*a*) are exaggerated and in fact bends 1001 should be made with as large a radius of curvature as reasonably possible to reduce radiation from leaking out. It is also possible to bend the image guide to the desired angle and keep the radiating tapers straight. By switching the signal from one antenna to another, coarse beam steering can be achieved. Fine beamsteering is performed through phase shifters in a beamforming manifold 540 using beamforming techniques known to those skilled in the antenna art. The coarse scan angle can either be switched on/off, or else separate signal processing circuits can be used for multiple beams from the aperture.

Figure 11:
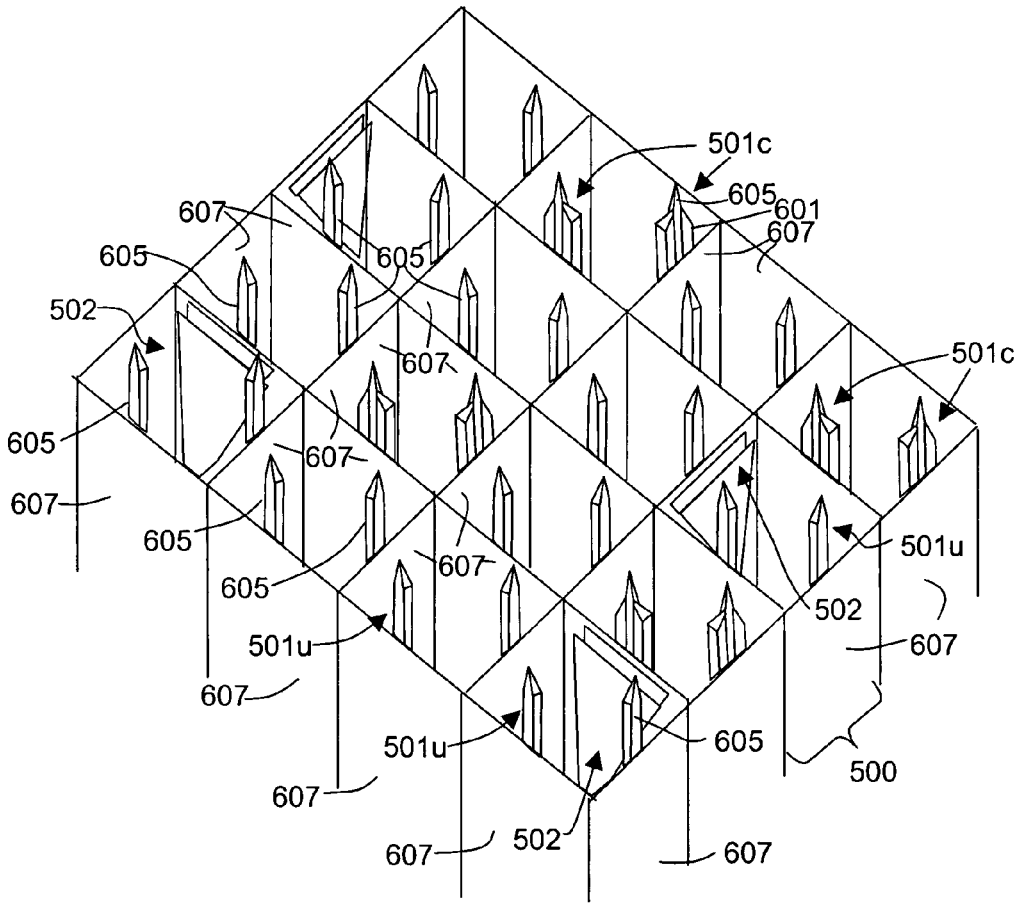
FIG. 11 is an embodiment of a thinned array embodiment constructed from a two dimensional array of ultra wideband antenna cards arrangement in a geometric pattern according to the present disclosure.

The integration of the ultra wideband element cards to form a two-dimensional antenna array is shown in less detail in FIG. 11 than previously shown in FIG. 5, but with greater numbers of cards 500. In FIG. 11 the dielectric portion(s) of the element cards 500 is(are) omitted for ease of illustration, so only the ground plane portions 607 of the element cards 500 are depicted. Whether the dielectric portions(s) of the element cards 500 support the distal ends of the antennas 501 is a matter of design choice. Dual polarization of the antenna pattern is accomplished by arranging the cards 500 in a square geometric pattern. Because of the high gain of the element cards 500, not all antenna components need to be present on all cards 500, as previously discussed. Array thinning is useful to reduce the complexity of the RF feed network and to reduce cost and weight of the array since not every card 500 need have both a dielectric rod antenna 501 and a TEM horn antenna 502.

As can be seen by reference to FIG. 11, four element cards 500 form a box-like structure. In the embodiment of FIG. 11, each box-like structure is defined by four ground planes 607, each of which at least has an associated core 605 of a dielectric rod antenna 501. Most of the cores 605 are uncladded (so that those antennas 501*u* operate in a single frequency band). A few of the cores 605 are cladded with an outer dielectric cladding or sleeve 601, so that those antennas 501*c* operate in two frequency bands. Since the outer cladding 601 supports a lower frequency band than does the inner core 605 alone, fewer of the dielectric rod antennas 501 in the structure need have a lower frequency capability due to array thinning. Still more frequency bands can be added by adding additional cladding layers (even more than by utilizing the TEM horn antenna 502, which will be discussed shortly), but such multi-cladded antenna elements would have an even lower packing density if used.

In the embodiment of FIG. 11, some of the dielectric rod antennas 501 are associated with a TEM horn antenna 502 disposed on the opposite side of the ground planes 607. Since the TEM horn antennas 502 support the lowest frequency band for the structure shown in FIG. 11, their packing density may be lower than that of either the uncladded or cladded dielectric core antennas 501*u* and 501*c*.

The two dimensional array of FIG. 11 would be useful for airborne and outer space based applications that require two dimensional beam steering. The array shown by FIG. 11 is only a portion of an actual array, which could be very large indeed, and that is one reason why inexpensive fabrication techniques and array thinning are important considerations in the design of such an array.

Figure 11A:
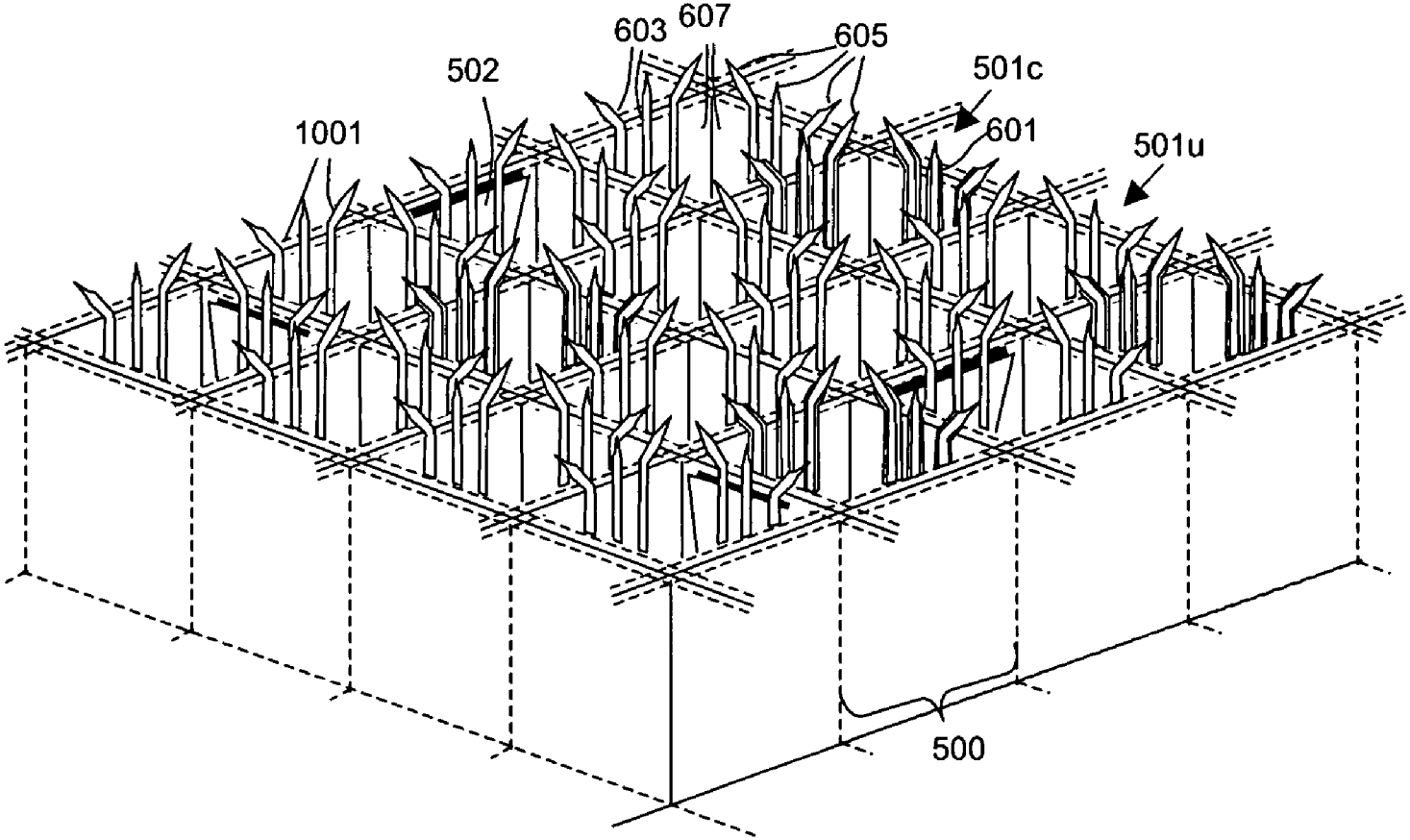
FIG. 11A depicts an embodiment similar to that of FIG. 11, but in this embodiment each wall of the antenna cards typically has on at least one side thereof, either a horn antenna or a group of three dielectric rod antennas, with certain ones of the groups of three of three dielectric rod antennas comprising groups of three cladded dielectric rod antennas, and in the case of each group of three dielectric rod antennas, whether cladded or not, each group is preferably arranged as shown in FIG. 10.

FIG. 11*a* shows an embodiment that is similar to the embodiment of FIG. 11, but in this embodiment, multiple dielectric rod antennas 501 are found on each card 500. But in this embodiment, the multiple dielectric rod antennas 501 have bends 1000 as previously described with reference to FIG. 10. Some of the multiple dielectric rod antennas on each card are cladded (501*c*), but most are uncladded (501*u*), due to array thinning and a desire to reduce the costs of the resulting array.

Figure 12A:
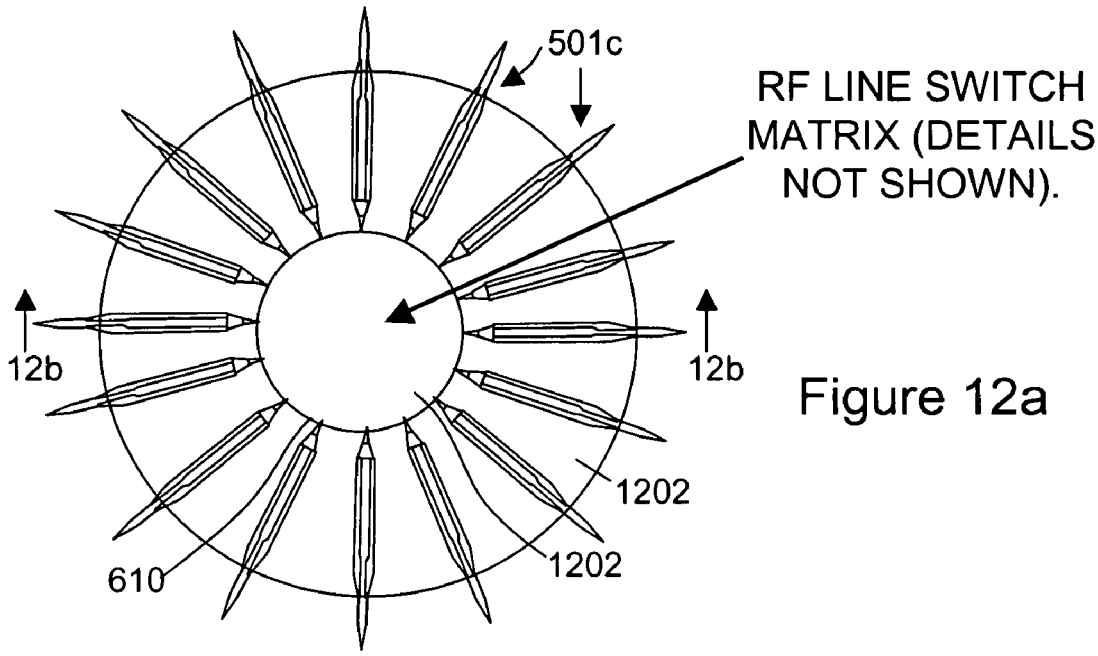
FIGS. 12*a* and 12*b* depict a top view and a side elevation view of another embodiment of an ultra wideband antenna beam switching array according to the present disclosure.
Figure 12B:
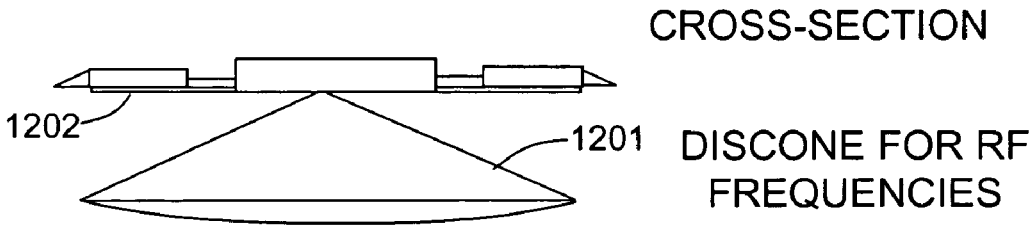

Another type of array that could be useful for land and sea mobile applications is the switched beam antenna shown in FIGS. 12*a* and 12*b*. Here, the plurality of ultra wideband cards 500 are replaced by an ultra wideband platform 500'. Beam steering is controlled by a switch matrix circuit 540 whose details are not shown, since beam steering is well known in the art. In this embodiment, the low frequency bands radiate through a broadband discone antenna 1201. The discone antenna 1201 is very simple to fabricate, but it is omni directional. If beam switching is required at the lower frequencies, the discone antenna 1201 may be segmented into sectors, where each sector is then switched on or off as needed.

In FIG. 12*a* a plurality of cladded dielectric rod antennas 501*c* are disposed on a dielectric surface 1202 that is preferably circularly shaped. The microstrip inputs 610 are preferably coupled in a cylindrical housing 1203 that preferably houses the aforementioned beam-steering switch matrix circuit 540. Otherwise, the dielectric rods antennas 501*c* in this embodiment are preferably embodied as shown in FIGS. 6 and 6*a*.

Returning now to the embodiments of FIGS. 5, 11 and 11*a*, because of the high gain of the element cards 500, not all antenna components need to be present on all cards 500. Preferably, antenna elements should be placed at a ½ wavelength separation to avoid grating lobes. The dielectrics code 603 is used to radiate the highest frequencies and thus would normally be required to be present on all cards (either in the form of an uncladded antenna 501*u* or in the form of the inner core 603 in a cladded antenna 501*c*) in order to maintain the ½ wavelength spacing. The cladded portions of the dielectric rod antennas 501*c* are used at lower frequencies, thus their ½ wavelength (A) spacing would be greater than the width of a single card 500; therefore, it is not needed to be present on every card 500, as shown in FIGS. 11 and 11*a* The TEM horn antenna 502 operates over the lowest frequency band, thus cards with the integrated TEM horn antenna are the least dense in the array while still maintaining a ½ wavelength spacing for them. As can be seen, array thinning is quite desirable in order to reduce the cost and complexity of the resulting array of cards 500.

Having described this technology in connection with certain embodiments thereof, modification will no doubt now suggest itself to those skilled in this technology. The appended claims are not to be taken as being limited to the disclosed embodiments, expect when specifically required by a given claim.

What is claimed is:

1. A device, comprising:

an element card having one or more embedded dielectric rod antennas disposed on a first side of said element card and a TEM horn antenna disposed on a second side of said element card, the one or more embedded dielectric rod antennas being tuned for relatively higher frequencies in a frequency band of interest and the TEM horn antenna being tuned for relatively lower frequencies in the frequency band of interest.

2. The device of claim 1, wherein each of the one or more dielectric rod antennas comprises an image guide feed section and a tapered dielectric rod antenna section.

3. The device of claim 2, wherein the image guide feed section contains a core of dielectric material of dielectric constant $\in_2$ embedded within a cladding of dielectric material of dielectric constant $\in_1$.

4. The device of claim 3, wherein the core and cladding are disposed immediately adjacent a conductive ground plane associated with the element card.

5. The device of claim 4, wherein additional cladding layers are arranged such that the core has the highest dielectric constant and each subsequent relatively outer cladding layer has a lower dielectric constant than a previous relatively inner layer.

6. The device of claim 3, wherein dielectric constant $\in_2$ is greater than dielectric constant $\in_1$.

7. The device of claim 3, wherein the cladding of the image guide feed section is tapered to outer edges of the core on a first end of the image guide feed section.

8. The device of claim 3, wherein the cladding and the core of the image guide feed section are tapered to a ridge on a second end of the image guide feed section.

9. The device of claim 8, wherein a microstrip-to-image guide RF transition connects the core to a microstrip transmission line feed.

10. The device of claim 9, wherein the input microstrip transmission line is fabricated as part of a multi-layer printed circuit board on the element card.

11. The antenna comprising an array of element cards according to claim 1.

12. The device of claim 1, wherein the TEM horn antenna is operatively coupled to a microstrip transmission line feed.

13. The device of claim 12, wherein a shaped dielectric insert is used for impedance matching the TEM horn with the microstrip transmission line.

14. A device, comprising:

an element card having one or more embedded dielectric rod antennas on a first side and a TEM horn antenna on a second side, the one or more dielectric rod antennas comprising an image guide feed section and a tapered dielectric rod antenna section, the element card having a ground plane disposed adjacent one or more image guide feed sections with the tapered dielectric rod antenna section of the one or more dielectric rod antennas being disposed beyond an edge of said ground plane.

15. The device of claim 14, wherein the image guide feed section contains a core of dielectric material of dielectric constant $\in_2$ embedded within a cladding of dielectric material of dielectric constant $\in_1$.

16. The device of claim 15, wherein the cladding of the image guide feed section is tapered to outer edges of the core on a first end of the image guide feed section.

17. The device of claim 16, wherein on a second end of the image guide feed section the core and the cladding separate into individual non-embedded image guides of higher and lower dielectric constant material.

18. The device of claim 17 wherein the non-embedded image guides of higher and lower dielectric constant material are connected to separate input microstrip transmission lines by image guide launchers.

19. The device of claim 18, wherein the input microstrip transmission lines are fabricated on a single printed circuit board on the element card.

20. The device of claim 18, wherein the image guide launchers are grounded-bow tie antennas.

21. The device of claim 17, wherein the image guide of higher dielectric material is inserted into the image guide of lower dielectric material to become the core of the embedded image guide section at a shallow angle in order to reduce RF signal scattering.

22. The device of claim 14, wherein the TEM horn antenna is connected to a microstrip transmission line feed.

23. The device of claim 22, wherein a shaped dielectric insert is used to impedance match the TEM horn antenna with the microstrip transmission line.

24. A method of achieving beam steering, comprising:

achieving course beam steering by dividing a field of view into two or more regions;

using embedded dielectric rod antennas located on each element card in an array of element cards to cover each region; and switching a signal from one embedded dielectric rod antenna to another.

25. The method of claim 24, further comprising configuring at least two of the embedded dielectric rod antennas on each card to point in different directions.

26. The method of claim 24, further comprising disposing image guides at a desired angle relative to radiating tapers.

27. The method of claim 25, wherein fine beam steering is achieved through phase shifters in a beam forming manifold.

28. The method of claim 27, further comprising switching course scan angles on/off.

29. The method of claim 27, further comprising using separate signal processing circuits for multiple beams from an aperture.

30. A device, comprising:

an array of one or more element cards having two or more dielectric rod antennas disposed thereon, each dielectric rod antenna representing a divided region of a field of view;

switching means to achieve course beam steering by switching a signal from one embedded dielectric rod antenna to another; and phase shifters in a beam forming manifold for performing fine beam steering.

31. A device, comprising:

an ultra wideband platform having a plurality of embedded dielectric rod antennas; and a discone antenna, the plurality of embedded dielectric rod antennas being disposed in a circular configuration on said wideband platform, the circular configuration of the plurality of embedded dielectric rod antennas being centered on an axis of said discone antenna.

32. The device of claim 31, wherein high frequency bands radiate via the ultra wideband platform and the low frequency bands radiate via the discone antenna.

33. The device of claim 32, further comprising a switch matrix circuit for controlling high frequency beam steering.

34. An antenna array comprising:

a plurality of element cards arranged in a geometric arrangement, each element card having a substrate and a ground plane covering at least a portion of the substrate, a set comprising at least a majority of the element cards, the elements cards of said set having an associated core dielectric rod disposed thereon over a portion of the ground plane thereof and having a tapered portion which is located beyond the ground plane thereof; and a subset of said set of element cards wherein the associated core dielectric rod is cladded by a cladded portion that partially covers the associated core dielectric rod with a dielectric material having a lower dielectric constant than the dielectric constant of the core dielectric rod antenna, the cladded portion having a tapered portion which is also located beyond the ground plane.

35. The antenna array of claim 34 wherein another subset of said set of element cards has a TEM horn antenna disposed on a second side of said substrate.

36. The antenna array of claim 35 wherein a number of members of said subset is greater than a number of members of said another subset.

37. The antenna array of claim 35 wherein the certain ones of said members of said another subset are also members of the first mentioned subset.

* * * * *